United States Patent [19]

Michalowski et al.

[11] Patent Number: 4,732,650

[45] **Date of Patent: * Mar. 22, 1988**

[54] BLEACHING OF CELLULOSIC PULPS USING HYDROGEN PEROXIDE

[75] Inventors: Robert J. Michalowski, Midland, Mich.; Steven H. Christiansen, Richwood, Tex.; Jimmy Myers, Sweeny, Tex.; David A. Wilson, Richwood, Tex.

[73] Assignee: The Dow Chemical Company, Midland, Mich.

[ * ] Notice: The portion of the term of this patent subsequent to Sep. 30, 2003 has been disclaimed.

[21] Appl. No.: 907,694

[22] Filed: Sep. 15, 1986

[51] Int. Cl.[4] ..... D21C 9/16

[52] U.S. Cl. ..... 162/17; 162/19; 162/76; 162/78; 162/80

[58] Field of Search ..... 162/17, 19, 76, 78, 162/80; 252/186.29, 186.43

[56] References Cited

U.S. PATENT DOCUMENTS

| | | | |
|---|---|---|---|
| 3,860,391 | 1/1975 | Kling et al. | 162/78 X |
| 4,599,138 | 7/1986 | Lindahl | 162/78 X |
| 4,614,646 | 9/1986 | Christiansen | 162/78 X |

*Primary Examiner*—Peter Chin
*Assistant Examiner*—Thi Dang
*Attorney, Agent, or Firm*—A. Cooper Ancona

[57] ABSTRACT

Bleaching of wood pulp is improved by the combination of a pretreatment of the pulp with a polyaminocarboxylic acid, e.g. ethylenediaminetetraacetic acid, prior to bleaching with an alkaline aqueous peroxide solution containing a stabilizing amount of an aminophosphonic acid derivative together with a polymer of an unsaturated carboxylic acid or amide or an alkylsulfonic acid substituted amide.

41 Claims, No Drawings

BLEACHING OF CELLULOSIC PULPS USING HYDROGEN PEROXIDE

BACKGROUND OF THE INVENTION

Hydrogen peroxide has been used for bleaching wood pulp during paper manufacture. Sodium silicate is normally employed as a stabilizer to prevent early depletion of the active bleaching agent.

In the process of making the pulp, metal ions are picked up from the wood, the water and the machinery used to masticate the wood chips and pulp. While some of the metal ion content is lost in the deckering or dewatering step, it is sometimes advantageous to add a chelating agent. Of the commercially available chelating agents, the sodium salt of diethylenetriaminepentaacetic acid has been reported to be the most effective. This is found in an article "The Effect of DTPA on Reducing Peroxide Decomposition", D. R. Bambrick, *TAPPI Journal,* June 1985, pp. 96–100. The use of silicates in such systems, however, results in problems when insoluble silicates are deposited upon the fibers and the machinery employed. When deposited on the pulp fibers the result is a harsher feel of the paper. The fouling of equipment can cause down-time and shortened life of the equipment. Because of this, silicate-free systems have been suggested.

These silicate-free systems have been found to work well in the single stage hydrogen peroxide bleaching of Kraft pulps where the choice of stabilizer possibly influences the bleaching mechanism by changing the reaction pathway of hydrogen peroxide. In such systems, the addition of poly-(α-hydroxyacrylate) as a stabilizer also has been shown to improve pulp brightness. The use of this stabilizer is discussed in a paper "Hydrogen Peroxide Bleaching of Kraft Pulp and the Role of Stabilization of Hydrogen Peroxide," by G. Papageorges, et al given at the ESPRA Meeting in Maastricht, Netherlands, May, 1979. British Pat. No. 1,425,307 discloses a method for preparing this stabilizer.

In U.S. Pat. No. 3,860,391 the bleaching of cellulose fibers and mixtures thereof with synthetic fibers is accomplished by employing peroxide in a silicate-free system in the presence of an aliphatic hydroxy compound, an amino alkylenephosphonic acid compound and, alternatively, with the addition of a polyaminocarboxylic acid. Representative of the above are erythritol or pentaerythritol, ethylenediaminetetra(methylenephosphonic acid) or 1-hydroxypropane-1,1,3-triphosphonic acid and ethylenediaminetetraacetic acid or nitrilotriacetic acid, respectively.

Another patent, U.S. Pat. No. 4,238,282, describes a pulp bleaching system employing chlorine (not peroxide) which uses various chelating agents, including polyacrylic acid (mol. wt. <2000), alkylene polyaminocarboxylic acids, and aminophosphonic acids and their salts.

Other more recent U.S. patents which employ such phosphonates as indicated above, but in a peroxide bleaching system, include U.S. Pat. No. 4,239,643 and its divisional U.S. Pat. No. 4,294,575.

While, as noted above, various combinations of chelating agents are useful in stabilizing peroxide bleaching systems, the presence of metal ions, e.g. iron, manganese and copper, provides a catalytic effect with respect to the decomposition of the peroxide and also tends to reduce the brightness of finished mechanical pulps. While the chelants might be expected to take care of minor amounts of the metal ions, the presence of significant amounts of magnesium and/or calcium ions which may be present in the wood pulp or water or both tends to overwhelm the ability of the chelants to complex the iron, manganese and copper ions present.

Certain combinations of the aminophosphonic acids together with polycarboxylic acids or polycarboxylic amides or a sulfonic acid derivative of a polyamide have been found to provide stabilization in the presence of significant amounts of magnesium and/or clacium ions and in the presence of small amounts of copper and the like metal ions which catalyze the peroxide decomposition. This stabilizer is disclosed in a copending application of one of the applicants in the present invention titled "Improved Stabilization of Peroxide Systems in the Presence of Alkaline Earth Metal Ions", Ser. No. 686,111, filed Dec. 24, 1984, now U.S. Pat. No. 4,614,646.

It has now been found that improved bleaching results by treating wood pulp with a polyaminocarboxylic acid prior to contacting the pulp with the stabilized aqueous peroxide solution referred to above.

SUMMARY OF THE INVENTION

In the process of bleaching wood pulp wherein wood chips are made into a pulp and subsequently submitted to a deckering or dewatering step and thereafter to bleaching by means of a peroxide solution, the improvement of contacting the pulp with (1) a polyaminocarboxylic acid, or salt thereof, prior to or in the deckering or dewatering step followed by (2) a peroxide solution together with the stabilizing components (a) an aminophosphonic acid chelant or salt thereof and (b) a polymer of (i) an unsaturated carboxylic acid or salt thereof (ii) an unsaturated carboxylic amide or (iii) an unsaturated carboxylic amide wherein the amide hydrogens are substituted with an alkylsulfonic acid group or salt thereof.

DETAILED DESCRIPTION OF THE INVENTION

This invention comprises an improvement involving two steps of the process of bleaching wood pulp for manufacture of paper products. The bleaching is accomplished in an alkaline aqueous peroxide system. Prior to the addition of the peroxide the pulp is dewatered to a solids content of from about 10–40% by weight.

The present invention is the discovery that when bleaching wood pulp with peroxide in a silicate-free system, the step of (1) pretreatment of the pulp with a polyaminocarboxylic acid or its ammonium, alkali metal or amine salt prior to bleaching followed by (2) bleaching with hydrogen peroxide stabilized with (a) an aminophosphonic acid, e.g. diethylenetriaminepentamethylenephosphonic acid or its ammonium, alkali metal or amine salt together with (b) a polymer of an unsaturated carboxylic acid or amide, e.g. acrylic acid, or its ammonium, alkali metal or amine salt and acrylamide.

The useful aminophosphonic acid derivatives are those corresponding to the formula

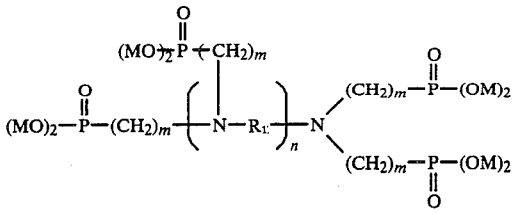

wherein M is independently selected from H, alkali metal, $NH_4$, and an amine radical, $R_1$ is an aliphatic straight or branched chain, cyclic or aromatic radical having from 2 to 6 carbon atoms, n is 0 to 12, and m is 1 to 3.

The polymeric acids and amides useful in the invention have the formulas

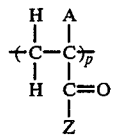

wherein A is independently hydrogen or methyl, Z is independently selected from $NH_2$ and OM and wherein M has the aforesaid meaning and p is from about 13 to about 5,500, preferably from about 25 to about 250 and wherein the Z substituents may be the same or different; and

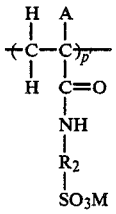

wherein $R_2$ is an alkylene radical having from 1 to 6 carbon atoms and p' is from about 5 to about 2,000, preferably from about 10 to about 350, and A and M have the above indicated meanings and wherein the M substituents may be the same or different.

Copolymers of monomers of the above formulas are also useful. Thus a partially hydrolyzed polyacrylamide is effective. Such polymers have molecular weights of from about 1,000 to about 400,000.

While the polyaminocarboxylic acids have previously been used in a silicate stabilized peroxide bleach system, e.g. see the previously mentioned Bambrick article, their use does not give the dramatic increase in brightness obtained by the present invention. Apparently, the addition of the polymer-aminophosphonic acid stabilized bleach, in the absence of silicate, creates an environment wherein pretreatment with a polyaminocarboxylic acid is not only highly desirable and efficient, but is critical to a superior bleaching of the pulp.

The polyaminocarboxylic acids useful in the pretreatment step of the bleaching process are the alkylenepolyaminopolycarboxylic acids having the formula

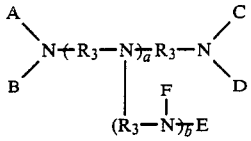

wherein A, B, C, D, E and F are independently selected from hydrogen, $CH_2COOR_4$, $CH_2CH_2OH$ and $CH_2CH(CH_3)OH$; $R_3$ is a hydrocarbon radical having the formula

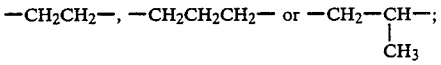

$R_4$ is hydrogen, an alkali metal, ammonium or an amine radical; a and b are each integers of 0–2.

Representative polyaminocarboxylic acids are ethylenediaminetetraacetic acid (EDTA), diethylenetriaminepentaacetic acid (DTPA), triethylenetetraminehexaacetic acid (TTHA) and N-hydroxyethylethylenediaminetriacetic acid (HEDTA).

Mixtures of polyaminocarboxylic acids can be used, especially mixtures of the completely carboxylated polyamine with those in which one amine hydrogen is replaced with a hydroxyethyl group, the remaining hydrogens being replaced by carboxymethyl groups. A particularly preferred blend is HEDTA or its salts and EDTA or its salts. Repesentative of the amine salts of the polyaminocarboxylic acids are their mono-, di- or trialkanolamine salts, e.g. the monoethanolamine salt of EDTA.

The following examples are illustrative of the invention.

To demonstrate the relative effectiveness of chelant pretreatment on both the polymer-phosphonate and silicate stabilized pulp bleaching systems, wood pulp from two mills was obtained. Samples of each pulp were first pretreated with a polyaminocarboxylic acid chelant. Then the treated pulp was bleached with an alkaline (initially pH >8) peroxide bleach liquor containing either silicate or the polymer-phosphonate stabilizer. After bleaching under the conditions shown in Table I, which are typical of those used in pulp mills, the bleach liquor was removed and the pH and residual peroxide were determined. The pH of the pulp was first adjusted to 4.5 to arrest the peroxide reaction and then the pulp was formed into a handsheet and dried. The handsheet was then measured for brightness (expressed in GE units). Where applicable, TAPPI Standard Methods were used.

TABLE I

BLEACHING CONDITIONS FOR THE TWO PULP SAMPLES

| | PULP #1 | PULP #2 |
|---|---|---|
| PRETREATMENT* | | |
| Time | 30 minutes | 45 minutes |
| Temperature | 75° C. | 50° C. |
| BLEACHING | | |
| Time | 60 minutes | 45 minutes |
| Temperature | 75° C. | 50° C. |
| Liquor Composition** | | |
| $H_2O_2$ | 1.5% | 2.0% |
| NaOH | 2.0% | 1.5% |
| $MgSO_4$ | 0.05% | 0.05% |
| Stabilizer | | |

TABLE I-continued

| BLEACHING CONDITIONS FOR THE TWO PULP SAMPLES | PULP #1 | PULP #2 |
|---|---|---|
| $Na_2SiO_3$ | 5.0% | 5.0% |
| (or) | | |
| DTPMP*** | 0.06% | 0.1% |
| NaPA | 0.06% | 0.1% |

*Various polyaminopolycarboxylic acids were used for the pretreatment of the pulp.
**Based on oven dried weight of pulp.
***DTPMP is diethylenetriaminepenta(methylenephosphonic acid) and NaPA is sodium polyacrylate.

The pretreatment and bleaching conditions as shown above were employed with pulp #1, using three different polyaminocarboxylic acids for the pretreatment at a level based on the oven dry weight of the pulp of 0.12% (or 6#/ton of the commercially available 40% solution). Example A is a control in which no pretreatment was used prior to the bleaching step. Examples 1, 2 and 3 used the sodium salts of ethylenediaminetetraacetic acid (EDTA), diethylenetriaminepentaacetic acid (DTPA) and hydroxyethylenediaminetriacetic acid (HEDTA), respectively, for the pretreatment. Results are shown in Table II. The differences (delta) between the control and each of the resulting brightness and residual peroxide measurements are shown in Table III for the same examples.

TABLE II

| BRIGHTNESS AND RESIDUAL PEROXIDE RESULTS, PULP #1 | PRETREATMENT | | | |
|---|---|---|---|---|
| | BRIGHTNESS (GE) | | % RESIDUAL $H_2O_2$ | |
| Example | $Na_2SiO_3$ | DTPMP + NaPA | $Na_2SiO_3$ | DTPMP+ NaPA |
| A | 62.2 | 60.6 | 15.3 | 5.9 |
| 1 | 63.8 | 65.3 | 30.4 | 33.8 |
| 2 | 62.7 | 64.9 | 31.4 | 27.4 |
| 3 | 63.0 | 64.9 | 31.1 | 31.1 |

TABLE III

| DELTA BRIGHTNESS AND RESIDUAL PEROXIDE, PULP #1 | PRETREATMENT | | | |
|---|---|---|---|---|
| | DELTA BRIGHTNESS | | DELTA RESIDUAL $H_2O_2$ | |
| Example | $Na_2SiO_3$ | DTPMP + NaPA | $Na_2SiO_3$ | DTPMP+ NaPA |
| 1 | 1.6 | 4.7 | 15.1 | 27.9 |
| 2 | 0.5 | 4.3 | 16.1 | 21.5 |
| 3 | 0.8 | 4.3 | 15.8 | 25.2 |

With pulp #1, the addition of a pretreatment does improve the brightness response and corresponding residual peroxide for both the silicate and polymer-phosphonate systems. The increase in brightness for the silicate system is only 0.5 to 1.6 units while the polymer-phosphonate system showed a 4.3 to 4.7 increase.

The same procedure was followed with pulp #2 using the same conditions shown in Table I and employing the same chelants. Example B is a control and Examples 4, 5 and 6 employed EDTA, DTPA and HEDTA, respectively at 0.12% based on the oven dry weight of pulp. Table IV shows the results and Table V shows the differences of each of the examples from that of the control.

TABLE IV

| BRIGHTNESS AND RESIDUAL PEROXIDE RESULTS, PULP #2 | PRETREATMENT | | | |
|---|---|---|---|---|
| | BRIGHTNESS (GE) | | % RESIDUAL $H_2O_2$ | |
| Example | $Na_2SiO_3$ | DTPMP + NaPA | $Na_2SiO_3$ | DTPMP+ NaPA |
| B | 71.1 | 60.8 | 25.6 | 0.3 |
| 4 | 70.8 | 71.1 | 54.3 | 54.5 |
| 5 | 70.9 | 70.6 | 49.1 | 36.0 |
| 6 | 71.2 | 71.6 | 51.8 | 54.3 |

TABLE V

| DELTA BRIGHTNESS AND RESIDUAL PEROXIDE, PULP #2 | PRETREATMENT | | | |
|---|---|---|---|---|
| | DELTA BRIGHTNESS | | DELTA RESIDUAL $H_2O_2$ | |
| Example | $Na_2SiO_3$ | DTPMP + NaPA | $Na_2SiO_3$ | DTPMP+ NaPA |
| 4 | −0.3 | 10.3 | 28.7 | 54.2 |
| 5 | −0.2 | 9.8 | 23.5 | 35.7 |
| 6 | 0.1 | 10.8 | 26.2 | 54.0 |

The effect of pretreatment on pulp #2 with the silicate system exhibited no benefit. On the other hand, the polymer-phosphonate system showed a dependence on pretreatment giving a 9.8 to 10.8 brightness increase.

In another control in which no pretreatment and no stabilizer for the peroxide were used the brightness of pulp #1 was 55.4 units and the residual $H_2O_2$ was 0.7%.

We claim:

1. In a process for bleaching wood pulp using hydrogen peroxide in an alkaline silicate-free aqueous system, the improvement which comprises the steps of (1) pretreating the pulp with a polyaminocarboxylic acid or salt thereof and (2) bleaching with hydrogen peroxide stabilized with (a) an aminophosphonic acid chelant or salt thereof and (b) at least one polymer of (i) an unsaturated carboxylic acid or salt thereof, (ii) an unsaturated carboxylic amide or (iii) an unsaturated carboxylic amide wherein the amide hydrogens are substituted with an alkylsulfonic acid group or salt thereof.

2. The process of claim 1 wherein the salts of the acids in steps (1) and (2) are independently selected from ammonium, an alkali metal or amine salts.

3. The process of claim 2 wherein the aminophosphonic acid chelant used in step (2) has the formula

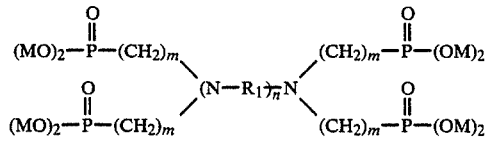

wherein M is independently selected from H, alkali metal, $NH_4$, or an amine radical, $R_1$ is an aliphatic straight or branched chain, cyclic or aromatic radical having from 2 to 6 carbon atoms, n is 0 to 12, and m is 1 to 3 and the polymer of b(i) or b(ii) has the formula

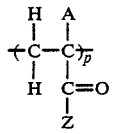

wherein A is independently hydrogen or methyl, Z is independently selected from $NH_2$ and OM and wherein M is independently selected from hydrogen, an alkali metal, ammonium and an amine radical and p is from about 13 to 5,500 and the polymer of b(iii) has the formula

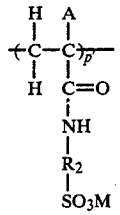

wherein $R_2$ is an alkylene radical having from 1 to 6 carbon atoms and p' is from about 5 to about 2,000 and A and M have the aforesaid meanings and mixtures of said polymers.

4. The process of claim 3 wherein the aminophosphonic acid chelant has the formula wherein m is 1 and n is 0 and the polymer of b(i) and b(ii) has the formula wherein p is an integer of from about 25 to about 250.

5. The process of claim 3 wherein the aminophosphonic acid chelant has the formula wherein m is 1 and n is 0 and the polymer of b(iii) has the formula wherein $R_2$ is an alkylene radical having 4 carbon atoms and p' is an integer of from about 10 to about 350.

6. The process of claim 3 wherein the aminophosphonic acid chelant has the formula wherein m is 1 and n is 1 and the polymer of b(i) and b(ii) has the formula wherein p is an integer of from about 25 to about 250.

7. The process of claim 3 wherein the aminophosphonic acid chelant has the formula wherein m is 1 and n is 1 and the polymer of b(iii) has the formula wherein $R_2$ is an alkylene radical having 4 carbon atoms and p' is an integer of from about 10 to about 350.

8. The process of claim 3 wherein the aminophosphonic acid chelant has the formula wherein m is 1 and n is 2 and the polymer of b(i) and b(ii) has the formula wherein p is an integer of from about 25 to about 250.

9. The process of claim 3 wherein the aminophosphonic acid chelant has the formula wherein m is 1 and n is 2 and the polymer of b(iii) has the formula wherein $R_2$ is an alkylene radical having 4 carbon atoms and p' is an integer of from about 10 to about 350.

10. The process of claim 3 wherein the aminophosphonic acid chelant has the formula wherein m is 1 and n is 3 and the polymer of b(i) and b(ii) has the formula wherein p is an integer of from about 25 to about 250.

11. The process of claim 3 wherein the aminophosphonic acid chelant has the formula wherein m is 1 and n is 3 and the polymer of b(iii) has the formula wherein $R_2$ is an alkylene radical having 4 carbon atoms and p' is an integer of from about 10 to about 350.

12. The process of claim 6 wherein $R_1$ is a 2-carbon aliphatic radical.

13. The process of claim 7 wherein $R_1$ is a 2-carbon aliphatic radical.

14. The process of claim 8 wherein $R_1$ is a 2-carbon aliphatic radical.

15. The process of claim 9 wherein $R_1$ is a 2-carbon aliphatic radical.

16. The process of claim 10 wherein $R_1$ is a 2-carbon aliphatic radical.

17. The process of claim 11 wherein $R_1$ is a 2-carbon aliphatic radical.

18. The process of claim 3 wherein the polyaminocarboxylic acid of step (1) has the formula

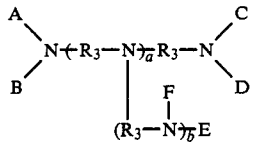

wherein A, B, C, D, E and F are independently selected from hydrogen, $CH_2COOR_4$, $CH_2CH_2OH$ and $CH_2CH(CH_3)OH$; $R_3$ is a hydrocarbon radical having the formula $$-CH_2CH_2-,\ -CH_2CH_2CH_2-\ \text{or}\ -CH_2-\underset{\underset{CH_3}{|}}{CH}-;$$

$R_4$ is hydrogen, an alkali metal, ammonium or an amine radical; a and b are each integers of 0–2.

19. The process of claim 14 wherein the polyaminocarboxylic acid of step (1) has the formula

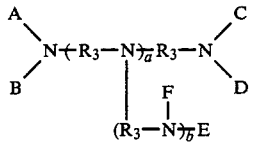

wherein A, B, C, D, E and F are independently selected from hydrogen, $CH_2COOR_4$, $CH_2CH_2OH$ and $CH_2CH(CH_3)OH$; $R_3$ is a hydrocarbon radical having the formula $$-CH_2CH_2-,\ -CH_2CH_2CH_2-\ \text{or}\ -CH_2-\underset{\underset{CH_3}{|}}{CH}-;$$

$R_4$ is hydrogen, an alkali metal, ammonium or an amine radical; a and b are each integers of 0–2.

20. The process of claim 15 wherein the polyaminocarboxylic acid of step (1) has the formula

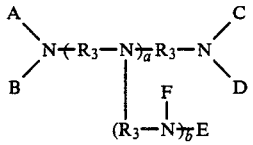

wherein A, B, C, D, E and F are independently selected from hydrogen, $CH_2COOR_4$, $CH_2CH_2OH$ and $CH_2CH(CH_3)OH$; $R_3$ is a hydrocarbon radical having the formula $$-CH_2CH_2-,\ -CH_2CH_2CH_2-\ \text{or}\ -CH_2-\underset{\underset{CH_3}{|}}{CH}-;$$

$R_4$ is hydrogen, an alkali metal, ammonium or an amine radical; a and b are each integers of 0–2.

21. The process of claim 18 wherein $R_3$ is $-CH_2CH_2-$, a is 0 and A, B, C and D are $CH_2COOR_4$.

22. The process of claim 21 wherein $R_4$ is alkali metal.

23. The process of claim 18 wherein $R_3$ is $-CH_2CH_2-$, a is 0, and one of A, B, C, D, E, or F is $-CH_2CH_2OH$ and the remainder are $CH_2COOR_4$.

24. The process of claim 23 wherein $R_4$ is alkali metal.

25. The process of claim 18 wherein $R_3$ is $-CH_2CH_2-$, a is 1, b is 0 and A, B, C, D and E are $CH_2COOR_4$.

26. The process of claim 25 wherein $R_4$ is alkali metal.

27. The process of claim 18 wherein the polyaminocarboxylic acid of step (1) consists essentially of a mixture of ethylenediaminetetraacetic acid and N-hydroxyethylethylenediaminetriacetic acid or alkali metal, ammonium, or amine salts thereof.

28. The process of claim 19 wherein $R_3$ is $-CH_2CH_2-$, a is 0 and A, B, C and D are $CH_2COOR_4$.

29. The process of claim 20 wherein $R_3$ is $-CH_2CH_2-$, a is 0 and A, B, C and D are $CH_2COOR_4$.

30. The process of claim 28 wherein $R_4$ is alkali metal.

31. The process of claim 29 wherein $R_4$ is alkali metal.

32. The process of claim 19 wherein $R_3$ is $-CH_2CH_2-$, a is 0 and one of A, B, C, D, E, or F is $-CH_2CH_2OH$ and the remainder are $CH_2COOR_4$.

33. The process of claim 20 wherein $R_3$ is $-CH_2CH_2-$, a is 0 and one of A, B, C, D, E, or F is $-CH_2CH_2OH$ and the remainder are $CH_2COOR_4$.

34. The process of claim 32 wherein $R_4$ is alkali metal.

35. The process of claim 33 wherein $R_4$ is alkali metal.

36. The process of claim 19 wherein $R_3$ is $-CH_2CH_2-$, a is 1, b is 0 and A, B, C, D and E are $CH_2COOR_4$.

37. The process of claim 20 wherein $R_3$ is $-CH_2CH_2-$, a is 1, b is 0 and A, B, C, D and E are $CH_2COOR_4$.

38. The process of claim 36 wherein $R_4$ is alkali metal.

39. The process of claim 37 wherein $R_4$ is alkali metal.

40. The process of claim 19 wherein the polyaminocarboxylic acid of step (1) consists essentially of a mixture of ethylenediaminetetraacetic acid and N-hydroxyethylethylenediaminetriacetic acid or alkali metal, ammonium, or amine salts thereof.

41. The process of claim 20 wherein the polyaminocarboxylic acid of step (1) consists essentially of a mixture of ethylenediaminetetraacetic acid and N-hydroxyethylethylenediaminetriacetic acid or alkali metal, ammonium, or amine salts thereof.

* * * * *